United States Patent [19]

Tomosada et al.

[11] Patent Number: 4,769,673

[45] Date of Patent: Sep. 6, 1988

[54] IMAGE SCANNING APPARATUS

[75] Inventors: Masahiro Tomosada, Kawasaki; Katsuyoshi Maeshima, Tokyo; Tsuneki Inuzuka, Machida; Hisashi Sakamaki, Yokohama, all of Japan

[73] Assignee: Canon Kabushiki Kaisha, Tokyo, Japan

[21] Appl. No.: 655,306

[22] Filed: Sep. 26, 1984

Related U.S. Application Data

[63] Continuation of Ser. No. 491,798, May 5, 1983, abandoned.

[30] Foreign Application Priority Data

| | | | |
|---|---|---|---|
| May 11, 1982 | [JP] | Japan | 57-79398 |
| May 11, 1982 | [JP] | Japan | 57-79399 |
| May 11, 1982 | [JP] | Japan | 57-79400 |
| May 11, 1982 | [JP] | Japan | 57-79401 |

[51] Int. Cl.[4] ..... G03G 15/04; G03G 21/00

[52] U.S. Cl. ..... 355/8; 355/14 R; 355/55

[58] Field of Search ..... 355/8, 14 C, 55, 56, 355/59, 14 R

[56] References Cited

U.S. PATENT DOCUMENTS

| | | | |
|---|---|---|---|
| 3,351,831 | 11/1967 | Hemphill et al. | 318/77 |
| 4,080,062 | 3/1978 | Torigai et al. | 355/49 |
| 4,211,482 | 7/1980 | Arai et al. | 355/8 |
| 4,218,735 | 8/1980 | McCutcheon | 355/14 R X |
| 4,243,311 | 1/1981 | Tohyama et al. | 355/8 |
| 4,287,461 | 9/1981 | Promis et al. | 355/8 |
| 4,310,241 | 1/1982 | Inoue | 355/60 |
| 4,327,994 | 5/1982 | Barley et al. | 355/14 R |
| 4,332,461 | 6/1982 | Cail et al. | 355/8 |
| 4,332,462 | 6/1982 | Yagasaki et al. | 355/8 X |
| 4,364,658 | 12/1982 | Seto et al. | 355/8 |
| 4,366,219 | 12/1982 | Beery | 355/8 X |
| 4,372,673 | 2/1983 | Tomosada et al. | 355/8 X |
| 4,379,631 | 4/1983 | Kitamura | 355/8 X |
| 4,383,753 | 5/1983 | Inuzuka et al. | 355/8 |
| 4,387,983 | 6/1983 | Masegi | 355/8 |
| 4,391,506 | 7/1983 | Koide | 355/55 |
| 4,413,900 | 11/1983 | Abe et al. | 355/8 |
| 4,415,259 | 11/1983 | Satomi | 355/8 X |
| 4,421,402 | 12/1983 | Komori et al. | 355/8 |
| 4,421,403 | 12/1983 | Sato et al. | 355/8 |
| 4,426,149 | 1/1984 | Kuemmel et al. | 355/8 |
| 4,431,299 | 2/1984 | Matsui et al. | 355/8 |
| 4,432,633 | 2/1984 | Nosaka et al. | 355/8 |
| 4,436,416 | 3/1984 | Negoro et al. | 355/8 X |
| 4,441,804 | 4/1984 | Shibazaki et al. | 355/8 X |
| 4,441,805 | 4/1984 | Smith | 355/55 |
| 4,453,824 | 6/1984 | Miyake et al. | 355/8 X |
| 4,456,366 | 6/1984 | Komiya et al. | 355/8 |
| 4,457,616 | 7/1984 | Tokuhara | 355/8 |
| 4,461,565 | 7/1984 | Yamada | 355/8 |

*Primary Examiner*—Fred L. Braun

*Attorney, Agent, or Firm*—Fitzpatrick, Cella, Harper & Scinto

[57] ABSTRACT

An image scanning apparatus has a reciprocating member for scanning a document, a first motor for driving the reciprocating member, a first detection circuit for detecting the speed of the first motor, a first control circuit associated with the detection circuit for rotating the motor at a speed to scan the document at a speed determined by a magnification factor, a recording medium, a second motor for driving the recording medium, a second detection circuit for detecting the speed of the second motor and a second control circuit associated with the second detection circuit for rotating the second motor at a speed determined by the magnification factor.

9 Claims, 7 Drawing Sheets

| FIG. 4A | |
|---|---|
| FIG. 4B | |

IMAGE SCANNING APPARATUS

This application is a continuation of application Ser. No. 491,798 filed May 5, 1983 now abandoned.

BACKGROUND OF THE INVENTION

1. Field of the Invention

The present invention relates to a scanning apparatus for an original image.

. 2. Description of the Prior Art

In a prior art copying machine capable of copying only at an equi-magnification, a position detector for determining a reversal point in accordance with the size of a copy sheet is provided in an optical system which scans a movable optical system in order to determine a scan length for an original. For example, reversal point detectors for copy sheet sizes of B5, A4, B4 and A3 are provided in the optical system, and when an A4 cassette is loaded in the copying machine, the optical system is reversed when it reaches the size A4 reversal point detector. In a copying machine with variable magnification copy function, it is usual that the copying is allowed at only a predetermined magnification factor such as from the size A3 to the size B4 or from the size A3 to the size A4. Accordingly, the scan length of the optical system can be relatively simply determined. For example, when the magnification factor is a reduction from the size A3 to the size B4, the scan length of the optical system is controlled by the size A3 reversal point detector.

In a copying machine having a multi-step variable magnification copy function, it is very complex to determine the scan length of the optical system because the magnification factor may be set to any desired length.

In a simple method, a maximum scan length is used without regard to the magnification factor and the copy sheet size. However, it is not practical because of low copying speed.

In the copying machine with continuously variable magnification copy function, it is difficult to synchronize the speed of a reciprocating means such as the optical system or original mount table with an overall speed of the copying machine because the speed of the reciprocating means is continuously variably changed.

A separate high speed motor may be used to return the scanner after the completion of scan, but it leads to increased cost.

When the multi-step variable scale copy function is used, an operator may not know what magnification factor is actually selected.

SUMMARY OF THE INVENTION

It is an object of the present invention to provide an image scanning apparatus which overcomes the above disadvantages.

It is another object of the present invention to provide an image scanning apparatus which can properly control the reversal of reciprocating means for scanning a document with a multi-step variable magnification copying function, in a minimum time period.

It is another object of the present invention to provide a copying machine capable of relatively moving a scanning system and a print system in a simple manner with a high accuracy.

It is yet another object of the present invention to provide an image scanning apparatus which enables the return of a scanner with a low cost.

It is a further object of the present invention to provide an image scanning apparatus which enables the display of a multiple of magnification factors with a low cost.

It is a further object of the present invention to produce an image forming apparatus which enhances high-reliability of image forming means such as a scanner and the like.

The above and other objects of the present invention will be apparent from the following description of the invention.

DETAILED DESCRIPTION OF THE PREFERRED EMBODIMENTS

Figure 1:
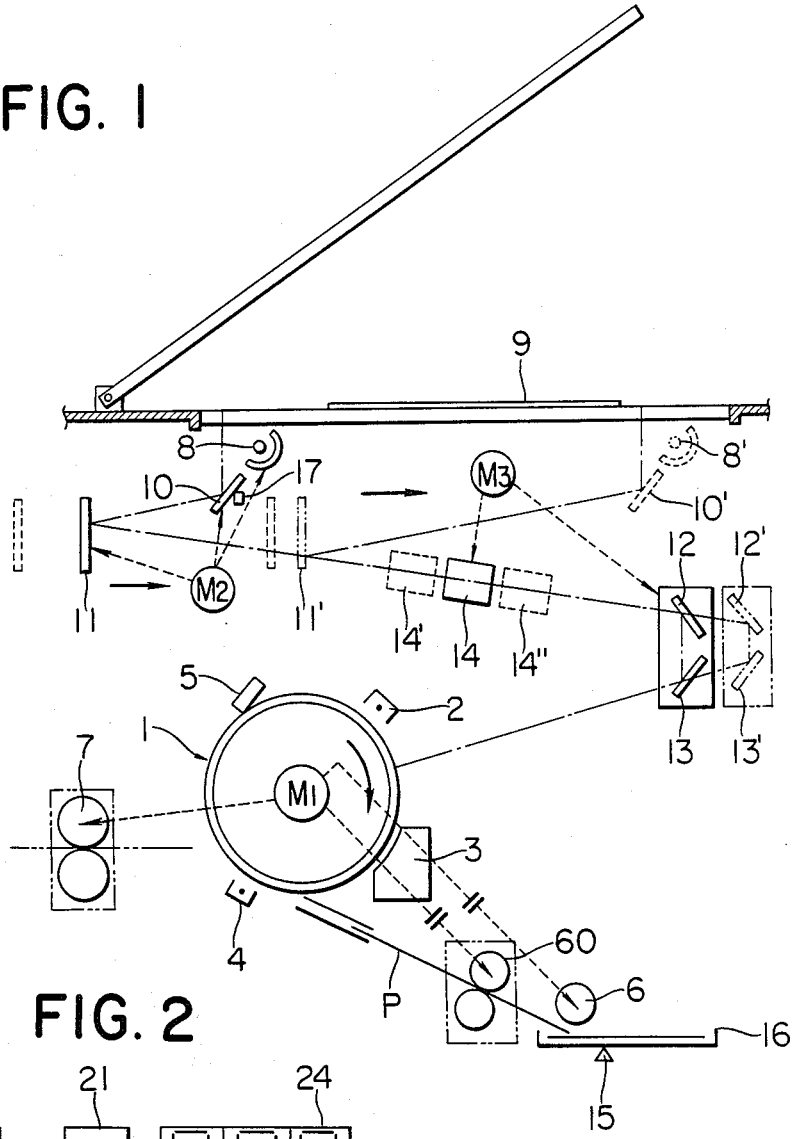
FIG. 1 is a sectional view of a copying machine to which the present invention is applied.

FIG. 1 is a sectional view of a copying machine to which the present invention can be applied. Numeral 1 denotes a photosensitive drum, numeral 2 denotes a primary charger, numeral 3 denotes a developing unit, numeral 4 denotes a transfer charger, numeral 5 denotes a cleaner, numeral 6 denotes a paper feed roller, numeral 7 denotes a fixing roller which forms a transfer image on a copy sheet P by a well-known electrophotographic process, numeral 8 denotes a lamp for exposing an original 9, numerals 10–13 denote mirrors, numeral 14 denotes a lens, numerals 10' and 11' denote mirror positions at the end of maximum scan, numerals 13' and 14' denote mirror lens positions for variable magnification factor, $M_1$ denotes a main motor for driving the drum 1 and the rollers 6 and 7, $M_2$ denotes a scan motor for reciprocating the lamp 8 and the mirrors 10 and 11 of the scanning system, and $M_3$ denotes a positioning motor for positioning the mirror 13 and lens 14. Those motors include D.C. servos. The lamp 8 and the mirrors 10 and 11 are reciprocated in a direction of an arrow at a velocity ratio of 1:0.5 to scan the original 9 and focus an image thereof on the drum 1. Numeral 15 denotes a microswitch for detecting size of a sheet cassette 16, and numeral 17 denotes a microswitch to define a home position (start position) of the scanning optical system.

Figure 2:
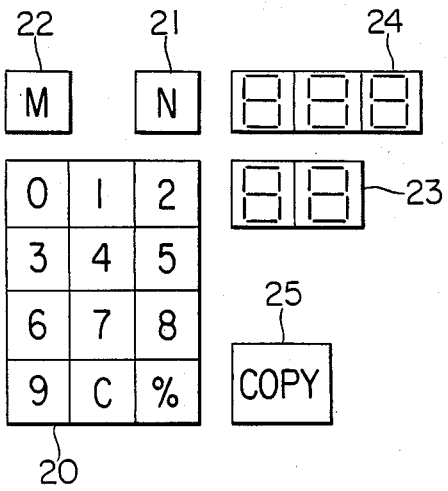
FIG. 2 is a plan view of a control panel of the copying machine of FIG. 1.

FIG. 2 shows a control panel, in which numeral 20 denotes a ten-key for inputting the number of copies and a magnification factor in binary data, numeral 21 denotes a function key for entering the data of the ten-key 20 as the number of copies and displaying it by a display 23, numeral 22 denotes a key for entering the data of the ten-key 20 as the magnification factor and displaying it by a display 24, and numeral 25 denotes a key for entering a copy start command. For example, when the key 22 is depressed and a data "50" is inputted by the ten-key 20, it means a reduction factor of 50% and "050" is displayed on the display 24, and when a data "150" is inputted, it means a magnification factor of 50% and "150" is displayed on the display 24. The original is scaled up or down by the magnification factor in both vertical direction and horizontal direction.

Figure 3:
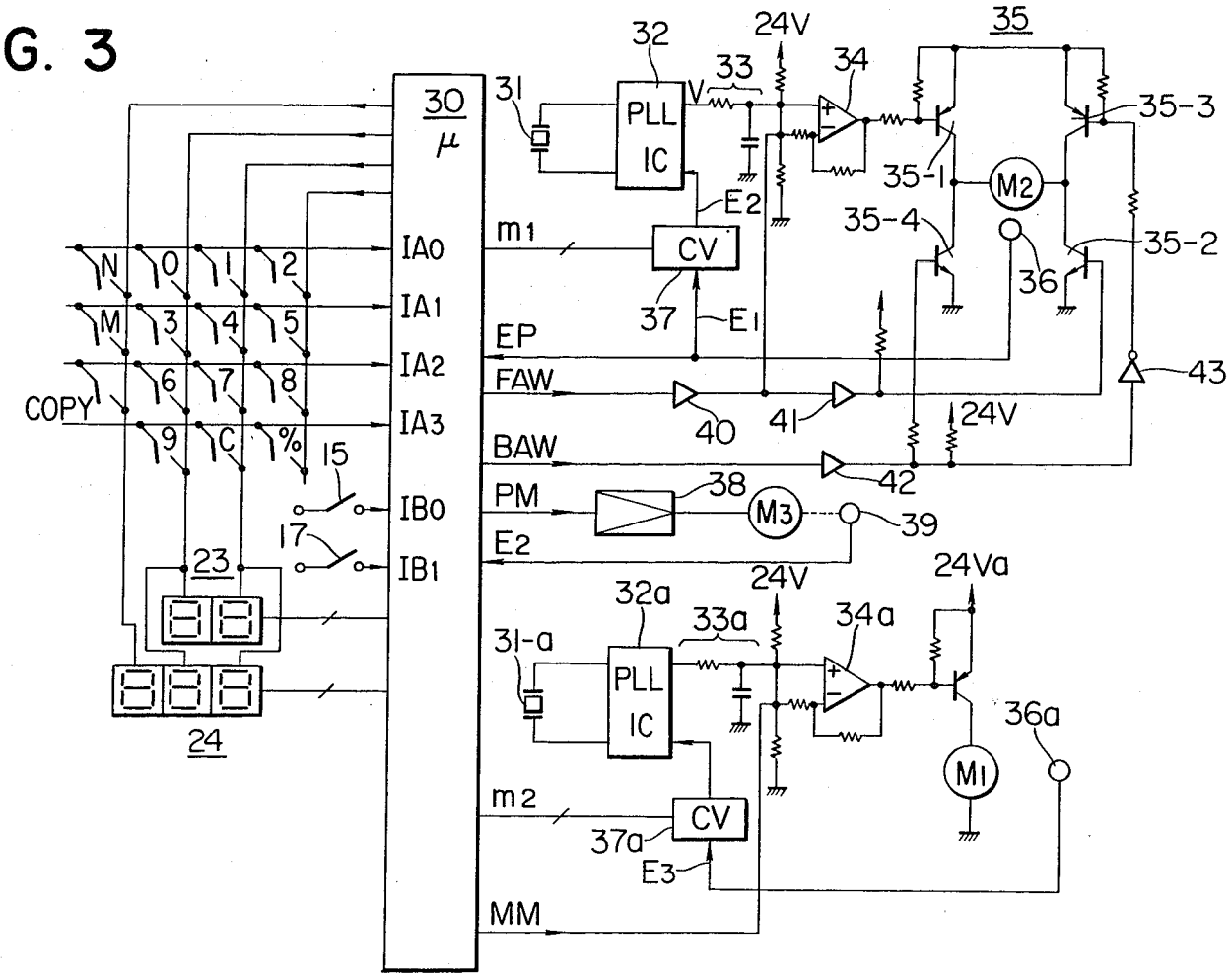
FIG. 3 shows a control circuit.
Figure 4A:
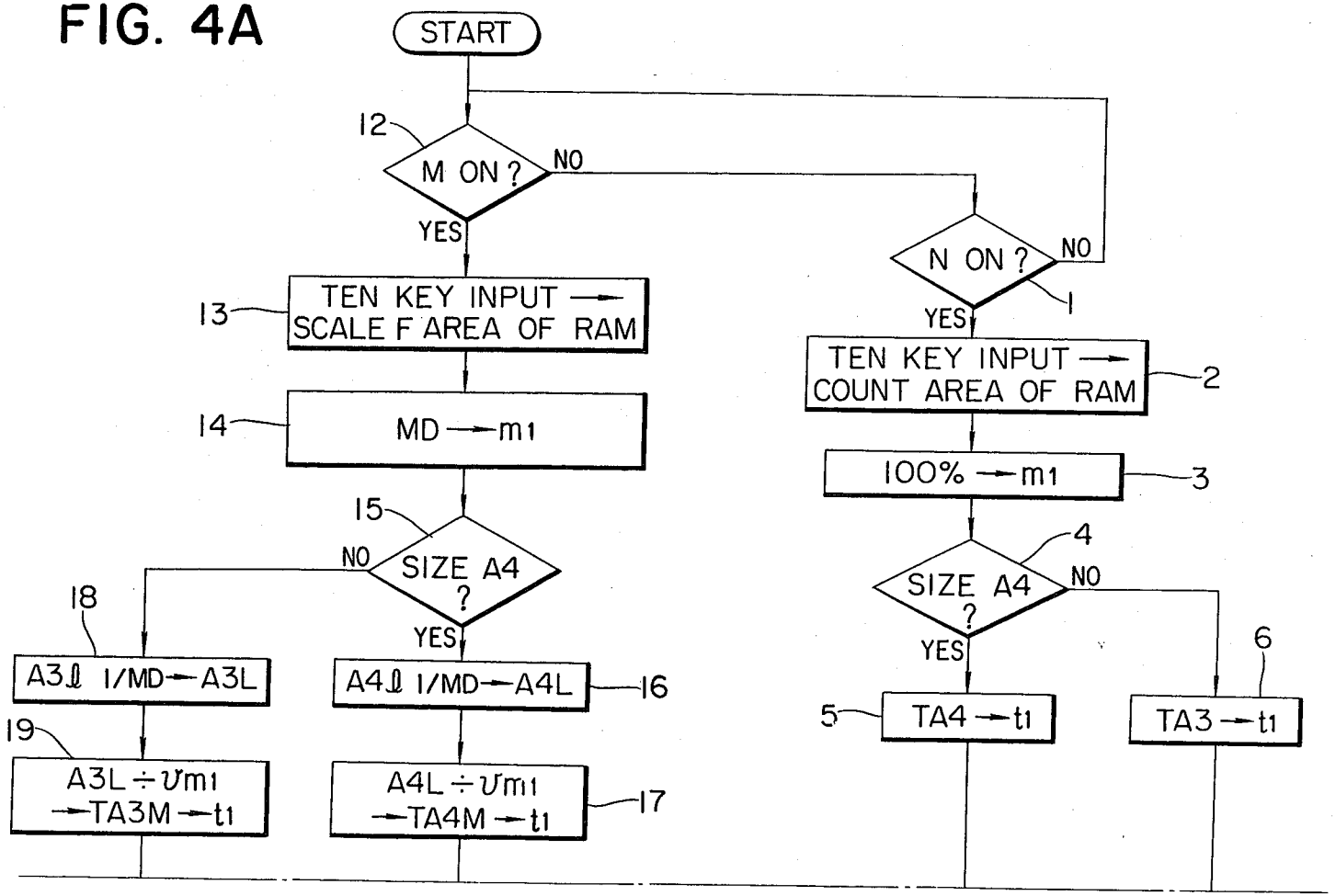
FIGS. 4A and 4B show a control flow chart for FIG. 3.
Figures 4, 4B:
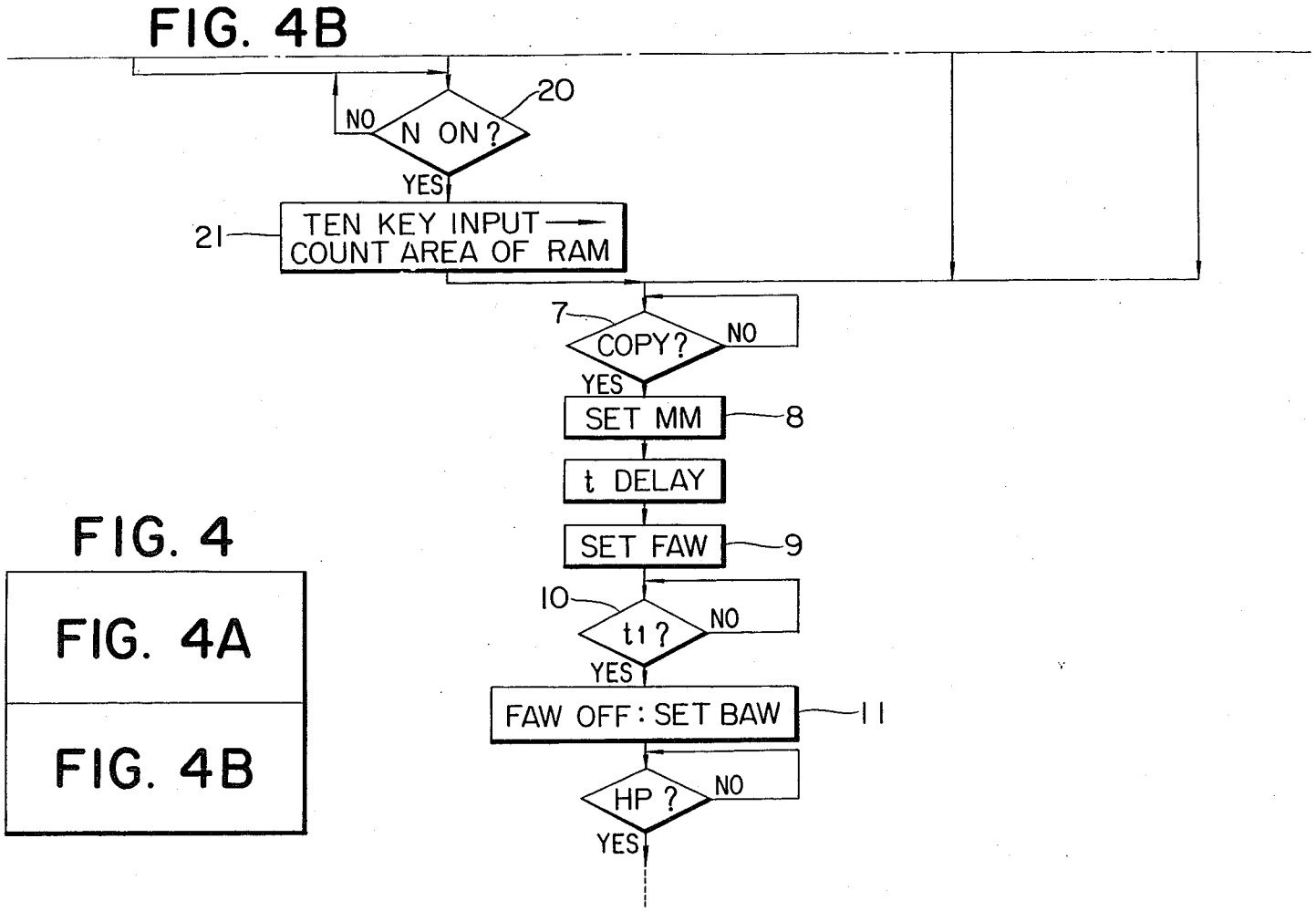
Figure 5:
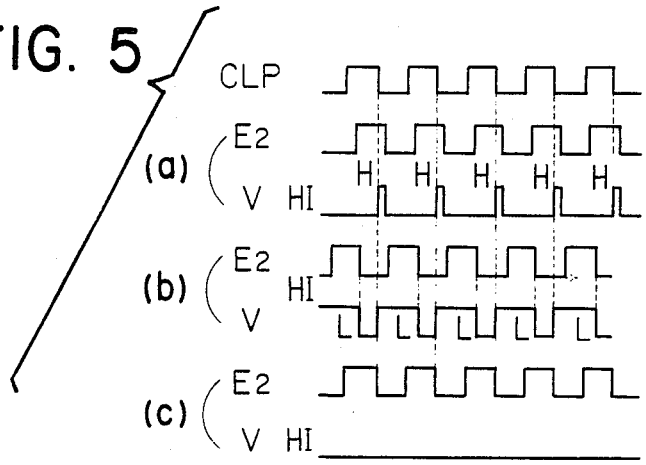
FIG. 5 shows output waveforms.

FIG. 3 shows a control circuit, in which numeral 30 denotes a microcomputer which has a ROM that stores a program as shown by a flow chart of FIG. 4, numeral 31 denotes a clock pulse generator corresponding to CLP in a time chart of FIG. 5, numeral 32 denotes a well-known PLL IC, numeral 33 denotes a low-pass filter, numeral 34 denotes a D.C. amplifier, numeral 35 denotes a circuit for switching rotation direction of the motor $M_2$, numeral 36 denotes a well-known encoder for detecting the velocity of the motor $M_2$, which comprises a photo-sensor for sensing perforations of a perforated disc coaxial with the motor $M_2$, and numeral 37 denotes a frequency divider for determining the velocity of the D.C. motor $M_2$, which frequency-divides the output of the encoder 36 to produce a signal $E_2$, which is supplied to the PLL 32. The PLL 32 compares the phase of the signal $E_2$ with the phase of the clock CLP and produces an output V as shown in FIG. 5 representative of a difference therebetween. As a result, the velocity of the motor $M_2$ is kept constant. A frequency division factor $m_1$ of the frequency divider CV is determined by a coded output of the microcomputer 30. The microcomputer 30 also supplies a forward signal FAW and a backward signal BAW for the scanning optical system to the rotation switching circuit 35 to switch the D.C. motor $M_2$ either forward or backward direction to select either the forward or backward movement. Numeral 38 denotes a D.C. amplifier for driving the lens positioning motor $M_3$, which is controlled by the output PM from the microcomputer 30. Numeral 39 denotes an encoder similar to the encoder 36 for determining the lens position. Numerals 31*a*, 32*a*, 33*a*, 34*a*, 36*a* and 37*a* associated with the main motor $M_1$ denote a clock pulse generator, a PLL-IC, a low-pass filter, a D.C. amplifier, an encoder and a frequency divider, respectively, which are similar to 31, 32, 33, 34, 36 and 37 associated with the scanning motor $M_2$. By those elements, the velocity of the motor $M_1$ is kept constant. The microcomputer 30 further produces a coded data for a frequency division factor $m_2$ and a rotation drive signal MM. Numerals 40–42 denote buffer amplifier and numeral 43 denotes an inverter amplifier.

In the present embodiment, a frequency $f_0$ of the basic pulse for the scanning motor $M_2$ and a frequency $f'_0$ of the basic pulse for the main motor $M_1$ are different from each other. As a result, a high quality of image at the equi-magnification copying is maintained without requiring strict coincidence between a pulley, a gear head and a motor rotor of the scanning system for conveying the driving power from the motor to the driven elements and those in the drum system. If the frequencies of the basic pulses are equal to each other, a strictly exact equi-magnification image cannot be produced unless the pulley diameter, the number of stages of the head, the rotation speed of the rotor and the torque are equal between the scanning system and the drum system, and it is very difficult from a design standpoint to make them equal. It has been found advisable to change the frequencies of the pulse sources 31 and 31*a* from each other so that the velocities of the respective systems are eventually equal.

The data from the keys of FIG. 2 is inputted to the microcomputer 30 by a well-known matrix system, and the data from the home switch 17 and the size switch 15 are also inputted.

Referring to FIG. 5, the velocity control of the main motor and the scan motor is explained with respect to the scan motor $M_2$. The D.C. amplifier 34 is activated by a high level of the signal FAW to turn on the transistor 35-1 and the transistor 35-2. A current flows through the transistor 35-1, the motor $M_2$ and the transistor 35-2 so that the motor $M_2$ is rotated forward to start the scan. The encoder 36 produces the pulse $E_1$ of the same frequency as the clock pulse CLK which drives the motor $M_2$ during the rotation of the motor $M_2$. If the frequency division ratio $m_1$ is 1, $E_1$ and $E_2$ are equal and the phases of $E_1$ and CLK are compared to indirectly determine a velocity deviation of the motor $M_2$. If the phases of $E_1$ and CLK are equal and the velocity corresponds to the clock CLK, a port (terminal) which outputs V is in a high impedance (HI) state and a positive (+) input to the D.C. amplifier 34 is not affected. Accordingly, the current supplied to the motor $M_2$ does not change and the motor velocity is constant. When the velocity of the motor $M_2$ reduces, $E_2$ changes as shown in FIG. 5(*a*). The PLL 32 compares the $E_2$ with the CLK and produces an output V which is a repetition of the high level (H) pulses. As a result, the filter 33 is slightly charged by the pulses. Thus, the input voltage to the D.C. amplifier 34 rises so that the current to the motor $M_2$ is increased to increase the velocity of the motor $M_2$. When the output of the encoder 36 coincides with the CLK as shown in FIG. 5(*c*), the output V of FIG. 5(*a*) is suppressed. Conversely, when the velocity increases, the PLL 32 produces an output V of low level as shown in FIG. 5(*b*). Accordingly, the low-pass filter 33 is slightly discharged. As a result, the input voltage to the D.C. amplifier 34 falls so that the current to the motor $M_2$ is reduced to reduce the velocity of the motor $M_2$. The above operation continues until the output of the endocer 36 is in phase with the CLK. In this manner, when the motor velocity deviates from the CLK rate, the velocity is restored and the correct velocity is maintained.

The velocity of the motor $M_2$ may be changed by a factor of $\frac{1}{2}$ or 2 in accordance with the magnification factor. In this case, the frequency division factor $m_1$ is changed by a factor of 2 or $\frac{1}{2}$ (with the velocity of the main motor $M_1$ being fixed). As a result, the motor $M_2$ can be rotated at the desired velocity, and the restore and maintain control is effected under this condition. The pulse train $E_1$ from the encoder 36 is frequency-divided in accordance with the frequency division factor set by the frequency division data $m_1$ from the microcomputer 30 to convert it to the pulse train $E_2$ having the same frequency as the clock CLP. Accordingly, the input voltage to the D.C. amplifier 34 is determined by the output of the PLL 32 such that the frequency of the pulse train from the encoder 36 is maintained at $\frac{1}{2}$ or 2 times of the frequency of the clock CLP.

The same control scheme is adopted for the main motor $M_1$.

The output frequencies of the clock generators 31 and 31*a* may be switched by the frequency division factors $m_1$ and $m_2$.

The forward and backward rotation of the motor $M_2$ is now explained. When the forward signal FAW assumes a low level, the transistors 35-1 and 35-2 are turned off and the forward rotation is suppressed. When the backward signal BAW assumes a high level, the transistors 35-3 and 35-4 are turned on and the motor $M_2$ is rotated backward. As a result, the scanning optical system is returned. During the backward rotation, a voltage of 24 volts is applied to the motor circuit so that the motor velocity is higher than any one of the forward rotation speeds. As a result, a high speed return is attained independently from the velocity detection circuit.

Referring to FIG. 4, the scan control in the continuously variable magnification factor copying is now explained. When a power switch of the apparatus is turned on, the microcomputer executes a key entry routine. It first determines whether the magnification factor key M or the normal key N has been depressed (step 1). If the normal key N has been depressed, the ten-key 20 is depressed and the data therefrom is regarded as the number of copies and it is stored in a count area of a RAM and the number is displayed on the display 23 (step 2). Then, the frequency division factor data $m_1$ of 1 (equi-magnification) or 100% is produced (step 3), and "100" is displayed on the display 24. Then, the status of the cassette switch 15 is read to determine whether the cassette size is A4 or not (step 4). When it is A4, $T_{A4}$ is stored in a scanning timer area $t_1$ of the RAM (step 5). $T_{A4}$ corresponds a time required for the motor $M_2$ to scan the length of the size A4 document. If it is not A4 but A3, $T_{A3}$ is stored in the timer area $t_1$ (step 6).

Then, the status of the copy key is determined (step 7), and if the copy key is on, the main motor $M_1$ is turned on to rotate the drum and others (step 8). Slightly later, the signal FAW is produced (t time later) to start the forward movement of the optical system. Since the frequency division factor $m_1$ is 1, the motor $M_2$ is rotated at the speed for the equi-magnification corresponding to the clock pulse. Then, it is determined whether the time $t_1$ corresponding to the scan stroke has elapsed (step 10), and if it has elapsed, the signal FAW is blocked and the signal BAW is produced to switch the rotation from forward to backward (step 11). And if a home position (HP) detector 17 is actuated, the scanner stops.

If the scale factor key M is depressed (step 12), the data entered by the ten-key is regarded as the magnification factor data MD and it is stored in the magnification factor area of the RAM (step 13). Based on the data MD, the frequency division factor $m_1$ is calculated, for example, 2 for the input data of 50% (step 14), and the magnification factor is displayed on the display 24.

The cassette size is determined in the same manner as the step 4 (step 15) and the scan distance for the sheet size is calculated. For example, for the size A4, the length A4l of the size A4 sheet is multiplied by 1/MD to obtain A4L (step 16). Thus, if the magnification factor is 50%, the distance is doubled. The time $T_{A4M}$ required to move across the distance A4L is determined based on the velocity $vm_1$ of the motor $M_2$ and it is stored in the timer area $t_1$ (step 17). The velocity $vm_1$ is previously stored in a table of a ROM so that it is determined by the clock CLP and the frequency division factor $m_1$.

In the present embodiment, since the velocity of the main motor $M_1$ is also changed in accordance with the magnification factor, the frequency division factors $m_1$ and $m_2$ are determined by the magnification factor data MD. For example, it is possible to set $m_1$ and $m_2$ in the step 14 so that $M_2$ is maximum at the equi-magnification and low at non-equi-magnification.

If the cassette size is A3, the scan length A3L is determined and the scan time therefor is determined (steps 18 and 19). Then, the key N is depressed and the ten-key is depressed, and the data therefrom is stored in the count area of the RAM as the data for the number of copies (steps 20 and 21).

The step 7 and the subsequent steps are then carried out to control the scan under non-equi-magnification factor. Thus, the cycle can be completed in a shortest time for the variable magnification factor. As a result, the time required for continuous copying can be minimized.

In the steps 17 and 19, instead of calculating the times and storing them in the memory, the numbers of pulses $N_4$ and $N_3$ from the encoder 36 corresponding to A4L and A3L may be counted and stored in the memory. In the step 10, the pulses applied from the encoder 36 to EP of FIG. 3 are counted from the time of start of forward movement, and when the count reaches $N_4$ (A4) or $N_3$ (A3), the signal FAW is blocked so that the stroke for the non-equi-magnification factor is determined.

Similarly, for the equi-magnification factor, the numbers of pulses $N_1$ and $N_2$ from the encoder corresponding to the sizes A4 and A3 may be counted in the steps 5 and 6 to determine the stroke.

In the step 14, the positioning motor $M_3$ is driven to determine the position of the lens for the non-equi-magnification factor. This can be attained by stopping the motor when the microcomputer counts a predetermined number of pulses from the encoder 39. By driving the registration roller 60 when the predetermined number of pulses from the encoder 36 have been counted since the start of the forward movement of the scanner, an exact registration timing for the scanner position can be determined.

Figure 6:
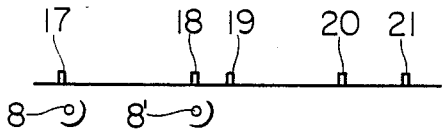
FIG. 6 shows a scan unit.
Figure 7:
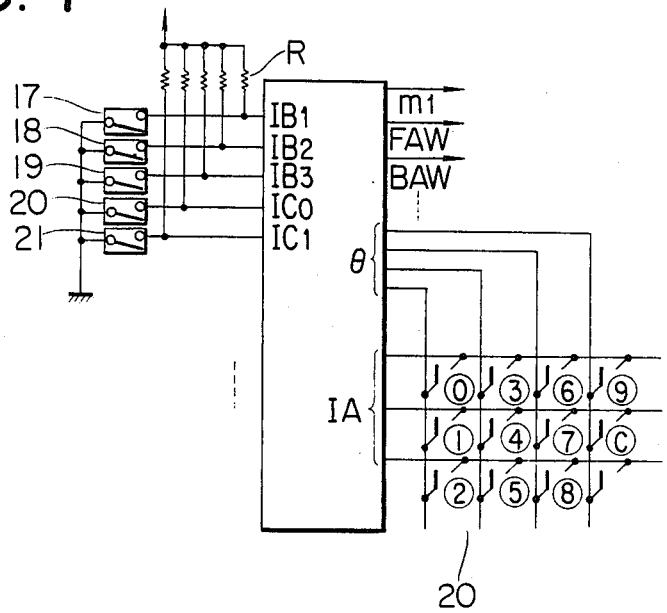
FIG. 7 shows another control circuit.
Figure 8:
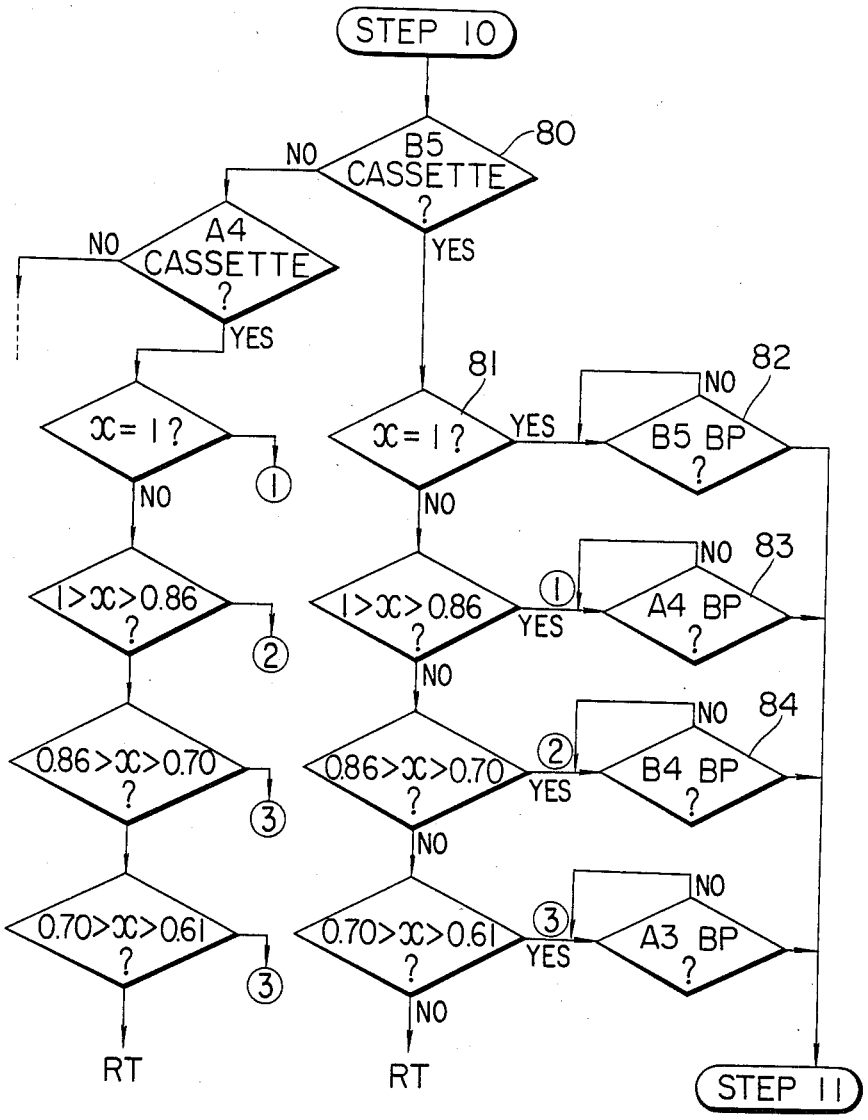
FIG. 8 shows another control flow chart.

Referring to FIGS. 6 to 8, another embodiment of the scan control is explained.

In FIG. 6, a plurality of position detectors 18–21 for the respective copy sheet sizes are arranged in the optical system (in the path of the mirror 10) which scans the movable optical system. For example, the detector for the mirror 10 for the optimum reversal point of the optical system for the equi-magnification copying for the copy sheet sizes B5, A4, B4 and A3 is provided so that the reduction of the copying speed for the equi-magnification copying which is most frequently used is prevented, and for the non-equi-magnification copying, the reversal point of the optical system is determined by the magnification factor and the copy sheet size. Table 1 shows a distance from the optical system home position to the reversal point.

TABLE 1

| | (optical system scan length) |
|---|---|
| B5 | 25 mm |
| A4 | 297 mm |
| B4 | 364 mm |
| A3 | 420 mm |

By way of example, an instance where the copy sheet size is B5 is explained.

When the magnification factor is 1.0 (equi-scale), the reversal point of the optical system is determined by detecting the reversal point sensor 18. When the magnification factor is smaller than 1 and larger than 0.86, the optical system is reversed by the A4 reversal point sensor (A4 BP) 19. When the magnification factor is smaller than 0.86 and larger than 0.70, the optical system is reversed by the B4 reversal point sensor 20, and when the magnification factor is smaller than 0.70 and larger than 0.61, the optical system is reversed by the A3 reversal point sensor.

By selecting one of the predetermined reversal points in accordance with the cassette size and the magnification factor, the optical system scan length can be controlled without increasing the number of reversal point sensors and without substantially reducing the copying speed.

In FIG. 7, the control of FIG. 6 is added to that of FIG. 3. The sensors (microswitches) are connected to the input ports.

FIG. 8 shows a control flow chart thereof. The reversal step 10 of FIG. 4 is replaced by it.

For the cassette size B5, it is determined if the magnification factor data is 1 or not (step 81), and if it is 1 (equi-magnification), it is checked if the B5 sensor 18 is on or not (step 82). If it is on, the process goes to the step 11 where the signal FAW is turned off and the signal BAW is turned on to start the backward movement. When the magnification factor x is $1>x>0.86$, for example $x=0.88$, the actuation of the A4 sensor 19 is waited (step 83). When $0.86>x>0.70$, for example $x=0.75$, the actuation of the B4 sensor 20 is waited (step 84). For the cassette size A4, the A4 sensor or larger size sensor is selected in accordance with the magnification factor. When the magnification factor x is in a first magnification range ($1.15>x>1$), the B5 sensor is selected for the cassette sizes B5 and A4. When the magnification factor x is in a second magnification range ($1.30>x>1.15$), the B5 sensor is selected for the cassette size B4 and smaller sizes, and when the magnification factor x is in a third magnification range ($1.40>x>1.30$), the B5 sensor is selected for the cassette size A3 and smaller sizes.

The original may be read by opto-electrical signal conversion means such as a CCD and the read data may be processed and transmitted or printed out. When the CCD is reciprocally moved along the CCD for scan, it may be moved by the D.C. motor $M_2$ and the control circuit. Thus, a variable magnification factor along the sub-scan direction is attained. A variable magnification factor in the direction of main scan is attained by storing the data read in the direction of line of the CCD in the memory by a clock (divided CCD clock) divided in accordance with the magnification.

It is possible to scan the original vertically (main scan direction) and horizontally (sub-scan direction) at different magnification factors from each other. In this case, the scan speed of the reciprocating member in the sub-scan direction is set in the manner described above. Namely, the horizontal magnification factor data is used as MD to control the magnification factor.

In an apparatus in which the original sheet is exposed while it is transported for scan, the speed of the roller to transport the original sheet may be controlled in the manner described above to attain the variable magnification factor.

The present invention is applicable to not only the apparatus having the D.C. motor as the drive means but also the apparatus having a pulse encoder.

Figure 9:
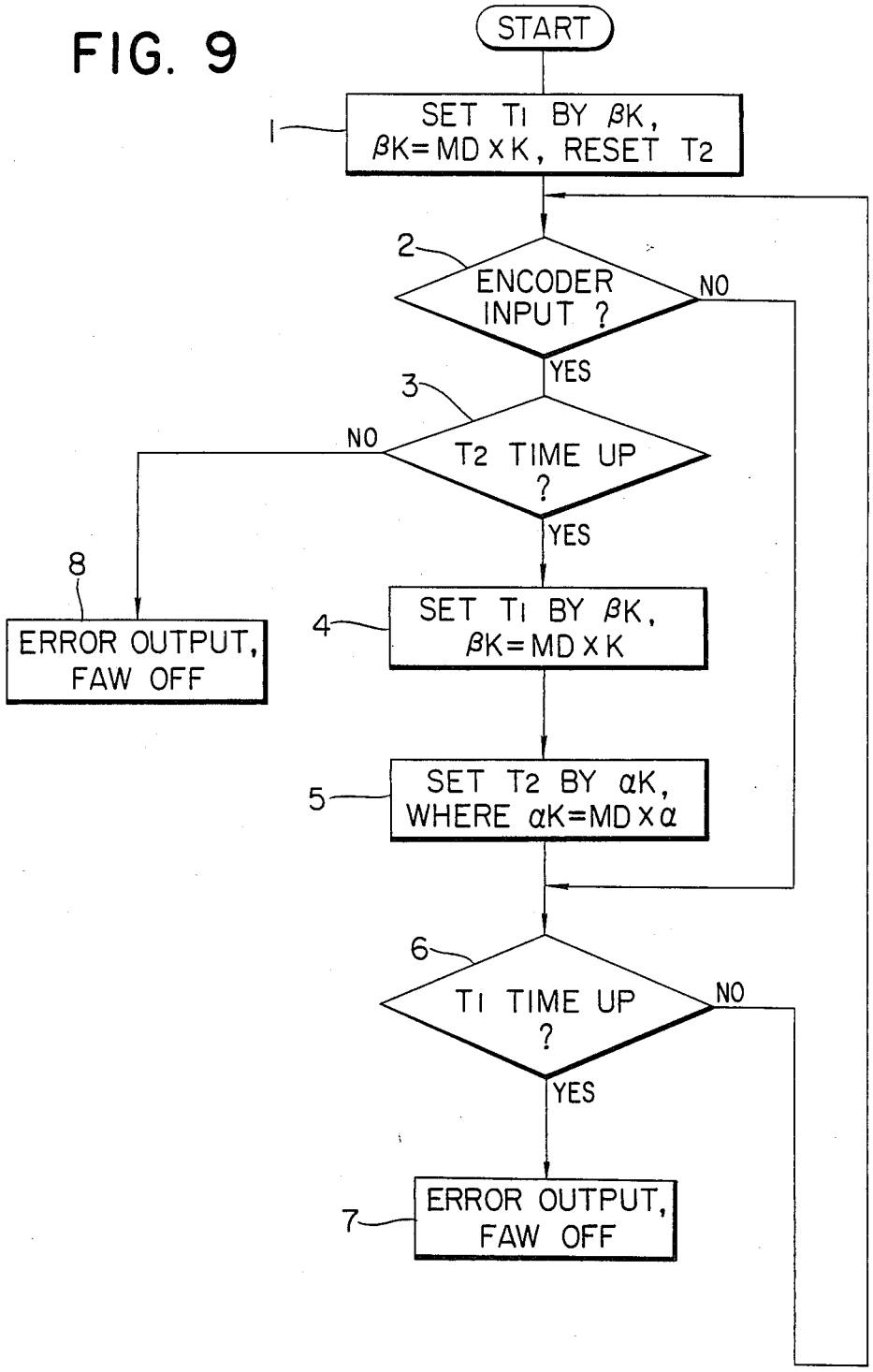
FIG. 9 shows a control flow chart in another embodiment.

In FIG. 9, an input pulse is applied to the port EP to diagnose the scanner by the microcomputer 30 of FIG. 3 so that an error signals is produced when an error condition exists.

In a step 1, a time BK corresponding to a maximum pulse interval to be regarded as an error is set in a timer $T_1$. The timer is one area of the memory. The time BK is determined by the magnification factor data MD. When a pulse is applied after the start of the forward movement of the scanner, it is detected and the process goes to a step 4. If the pulse is not applied, a step 6 is repeated and when the time-up of the timer $T_1$ is detected, an error signal is produced and the forward signal FAW is turned off (step 7). If the pulse is applied, the timer $T_1$ is again set in the step 4 and the next pulse interval is checked. A step 3 is passed because the timer $T_2$ has been reset in the step 1. In a step 5, the timer $T_2$ is set. The timer $T_2$ detects if the motor speed is too fast. A time $\alpha K$ corresponding to a minimum pulse interval to be regarded as an error is set in the timer $T_2$. It is determined by the magnification factor data MD. When the pulse is next applied, the time-up of the timer $T_2$ is checked in a step 9, and if it is timed up, the operation is normal, and if it is not timed up, an error signal is produced and the signal FAW is turned off to stop the movement of the scanner.

It is possible to display the errors separately for the timers $T_1$ and $T_2$. In this manner, abnormal speed of the scanner can be checked and if the speed exceeds a controllable range, an alarm is issued or the machine is stopped. This monitoring is effected over the entire time period of the rotation of the motor $M_2$. Accordingly, the error condition can be checked when the motor is reversed to return the scanner.

It is also possible to check errors as aforesaid by applying a speed signal $E_3$ of the main motor $M_1$ to a microcomputer 30.

What we claim is:

1. A copying machine comprising:

means for scanning a document;

a first drive source for driving said scanning means;

means for entering a magnification factor of a reproduced image of said document, said entering means including key means for instructing a magnification factor;

first detection means for detecting a speed of said first drive source;

first control means associated with said first detection means for controlling a speed of said first drive source in accordance with the magnification factor entered by said entering means, said first control means including a micro computer which inputs a binary signal from said entering means;

a recording medium for recording a reproduced image corresponding to the document scanned by said scanning means;

a second drive source for driving said recording medium;

second detection means for detecting a speed of said second drive source; and second control means associated with said second detection means, for controlling a speed of said second drive source in accordance with the magnification factor entered by said entering means.

2. A copying machine according to claim 1 wherein said scanning means is returned by the reversal of said first drive source.

3. A copying machine according to claim 1 wherein frequencies of basic pulses for said first drive source and said second drive source are different from each other.

4. A copying machine according to claim 1, wherein said recording medium is a photosensitive drum.

5. A document scanning apparatus comprising:

reciprocating means for scanning a document;

a drive source for driving said reciprocating means;

pulse generating means associated with said drive source;

means for controlling said drive source in response to the pulses from said pulse generating means to move said reciprocating means at a predetermined speed; and means for detecting an abnormality in the pulses from said pulse generating means to produce an error signal;

wherein said abornmality detecting means is capable of detecting an abnormality in the pulses in a first mode and in a second mode;

wherein said abnormality detecting means includes first timer means for counting a first predetermined time period and generates said error signal to stop said apparatus if said pulses are not generating while said first timer means counts said first predetermined timer period; and wherein said abnormality detecting means includes second timer means for counting a second predetermined time period and generates said error signal to stop said apparatus if said pulses are generated when said second timer means counts said second predetermined time period, in said second mode.

6. An apparatus according to claim 5, wherein said pulse generating means includes means for detecting a speed of said drive source, and wherein said control means controls said drive source at a desired speed in accordance with the pulses from said detecting means.

7. An apparatus according to claim 6, further comprising means for entering a magnification factor of a reproduced image of said document, wherein said control means controls said drive source in accordance with the pulses from said detecting means to scan said document at a desired speed in response to the magnification factor entered from said entering means.

8. An apparatus according to claim 7, further comprising a second control means for controlling said drive source to return said reciprocating means after the completion of the scan of said document, wherein said second control means provides a predetermined output to said drive source independently from said detecting means.

9. An apparatus according to claim 7, wherein said abnormality detecting means sets a value corresponding to the entered magnification factor in said first timer means and second timer means.

* * * * *

UNITED STATES PATENT AND TRADEMARK OFFICE

CERTIFICATE OF CORRECTION

PATENT NO. : 4,769,673

DATED : September 6, 1988

INVENTOR(S) : MASAHIRO TOMOSADA, ET AL.

It is certified that error appears in the above-identified patent and that said Letters Patent is hereby corrected as shown below:

COLUMN 3, line 46, "buffer amplifier" should read --buffer amplifiers--.

COLUMN 4, line 38, "endocer 36" should read --encoder 36--.

COLUMN 5, line 24, "corresponds" should read --corresponds to--;

line 31, "system." should read --system (step 9).--

COLUMN 7, line 38, "CCD is" should read --original is--;

line 45, "magnification." should read --magnification factor.--;

line 63, "signals" should read --signal--.

UNITED STATES PATENT AND TRADEMARK OFFICE

CERTIFICATE OF CORRECTION

PATENT NO. : 4,769,673

DATED : September 6, 1988

INVENTOR(S) : MASAHIRO TOMOSADA, ET AL.

It is certified that error appears in the above-identified patent and that said Letters Patent is hereby corrected as shown below:

COLUMN 9, line 11, "abornmality" should read --abnormality--;

line 20, "timer" should read --time--.

Signed and Sealed this

Ninth Day of January, 1990

*Attest:*

JEFFREY M. SAMUELS

*Attesting Officer*

*Acting Commissioner of Patents and Trademarks*